United States Patent [19]

Bressler et al.

[11] Patent Number: 4,718,882

[45] Date of Patent: Jan. 12, 1988

[54] CARTON STOP ASSEMBLY

[75] Inventors: Allen K. Bressler; Keith D. Hixson, both of Cedar Rapids, Iowa

[73] Assignee: Cherry-Burrell Corporation, Cedar Rapids, Iowa

[21] Appl. No.: 919,068

[22] Filed: Oct. 15, 1986

[51] Int. Cl.[4] ..... B31B 1/28

[52] U.S. Cl. ..... 493/164; 493/165; 493/183; 493/184; 53/565

[58] Field of Search ..... 493/122, 126, 164, 165, 493/180, 183, 184, 147; 53/563, 565; 221/191; 414/131, 125, 900; 271/236, 245

[56] References Cited

U.S. PATENT DOCUMENTS

| | | | |
|---|---|---|---|
| 1,014,269 | 1/1912 | Tichborne | 271/59 |
| 3,486,423 | 12/1969 | Mistarz | 493/164 |
| 3,785,113 | 1/1974 | Martensson et al. | 493/184 |
| 4,301,911 | 11/1981 | Albo | 493/180 |
| 4,456,118 | 6/1984 | Kauffman et al. | 198/480 |
| 4,588,391 | 5/1986 | Evans et al. | 493/165 |

*Primary Examiner*—Robert P. Olszewski
*Assistant Examiner*—Robert Showalter
*Attorney, Agent, or Firm*—Fitch, Even, Tabin & Flannery

[57] ABSTRACT

Disclosed is a carton stop assembly for use in a machine which performs operations on a carton blank, and which includes a rotatable hub carrying a plurality of spaced radial mandrels, and insertion mechanism for telescopically inserting a carton blank over one of the mandrels. The carton stop assembly includes a track parallel to the one mandrel, having plurality of detents spaced therealong. An axially-reciprocable shaft has a first end overlying the one mandrel, and a second end overlying the track. The shaft carries track-engaging members at its second end, which enclose the detents on the track thereby stopping the shaft at a plurality of detent positions. A carton-engaging bracket is carried on the first end of the shaft and is arranged to overlie the one mandrel. As the shaft is reciprocated to a number of detent positions, the carton-engaging bracket is also placed at a number of positions along the mandrel.

6 Claims, 7 Drawing Figures

26
42
43
44
46'
75
100
142
144
136
116
112
160
162
108
114
150
118
106
110
176
38

2
2
26
27
38
40
42
44
46
46'
47
48
50
52
55
56
58
72
74
75
100
114
116
118
136
150

5
168
108
112
114
6
124
110
106
122
118
128
150
176
5

7
137
136
140
142
144
146
116
112
27
270
160
164
162
164

CARTON STOP ASSEMBLY

BACKGROUND OF THE INVENTION

1. Field of the Invention

The present invention pertains to apparatus for limiting the insertion of a tube-like carton blank onto a mandrel. More particularly, the present invention relates to a single carton stop assembly associated with a turret which carries a plurality of tube-receiving mandrels between carton-forming stations disposed about the mandrels.

2. Description of the Prior Art

Machines for the automated fabrication of gable-top cartons formed from blanks of paperboard or the like material are well-known in the art. The more popular types of carton-forming stations typically include a hub or turret carrying a plurality of spaced radial mandrels. A plurality of work stations for carrying out operations on a carton blank are disposed about the mandrels at various radial positions. The carton-forming sequence is initiated at a first station where flattened carton blanks are opened and inserted onto a mandrel, the mandrel thereafter being rotated through a succession of stations which perform a variety of operations on the carton blank.

Machines of this type frequently have a number of moving assemblies in motion about the turret. For example, a stripper system reaches toward a mandrel containing a fully formed carton, to extract the carton therefrom. Conveyor systems are in motion about the turret to position formed cartons into an array which is carried downstream to subsequent stations for filling, and sealing, for example. It is therefore generally undesirable to require an operator to reach into and around the turret, and particularly adjacent the mandrels of the turret, which are constantly being indexed from station to station. Further, even if otherwise desirable, access to the mandrels is restricted in that several closely-spaced turrets are usually ganged together, on a common shaft.

Frequently, a single carton-forming and filling assembly line will be relied upon to accommodate a variety of carton sizes throughout a typical production period. One adjustment that must be made upon changeover to accommodate cartons of different lengths, is that assemblies for limiting the amount of insertion of a carton tube onto the mandrels must be adjusted, since the bottom portions of carton blanks of different lengths must all be similarly aligned adjacent the free end of the mandrel. Similar alignment is required, since the same bottom-forming operations are performed, regardless of carton size.

As can be seen from the above, it is undesirable to have an operator contact the mandrels to adjust any carton stops that may be mounted thereon. An example of this stop member arrangement is given in U.S. Pat. No. 4,456,118 issued June 26, 1984, to Kauffman et al. In this type of arrangement, carton stops on each mandrel of a turret must be adjusted when a different size carton is run through an assembly line. Not only must the machine be temporarily halted during such adjustment, but also there is always the risk that the machinery may be inadvertently activated while the operator is reaching into the interior of the turret mechanism.

SUMMARY OF THE INVENTION

It is therefore the principal object of the present invention to provide a carton stop assembly in which the relative position of a carton stop along a tube-receiving mandrel can be adjusted at points remote from the mandrel assembly, free from moving machinery.

Another object of the present invention is to provide a carton stop apparatus in which a single carton-stop assembly is provided for a given turret, and which is operatively associated for each mandrel carried on the turret.

These and other objects of the present invention, which will be come apparent from studying the following description when the same is considered in connection with the accompanying drawings, are provided by an adjustable stop means for use with a machine for performing operations on a tubular carton blank. The machine includes a rotatable hub carrying a plurality of spaced radial mandrels, and insertion means for telescopically inserting a tubular blank over one of the mandrels at a first radial position. The stop means comprises a shaft having a first end adjacent the one mandrel and a second end remote from the rotatable hub. The shaft is mounted for axial movement, and the second end of the shaft has a handle for imparting an axially-directed force to the shaft. Carton engaging means are located at the first end of the shaft for engaging a carton blank inserted over the one mandrel, to limit the extent of insertion thereof. Detent means are provided for selectively positioning the carton engaging means at a plurality of positions along the mandrel.

BRIEF DESCRIPTION OF THE DRAWINGS

In the drawings, wherein like elements are referenced alike.

Corresponding reference characters indicate corresponding components throughout several views of the drawings.

DETAILED DESCRIPTION OF THE PREFERRED EMBODIMENT

Figure 1:
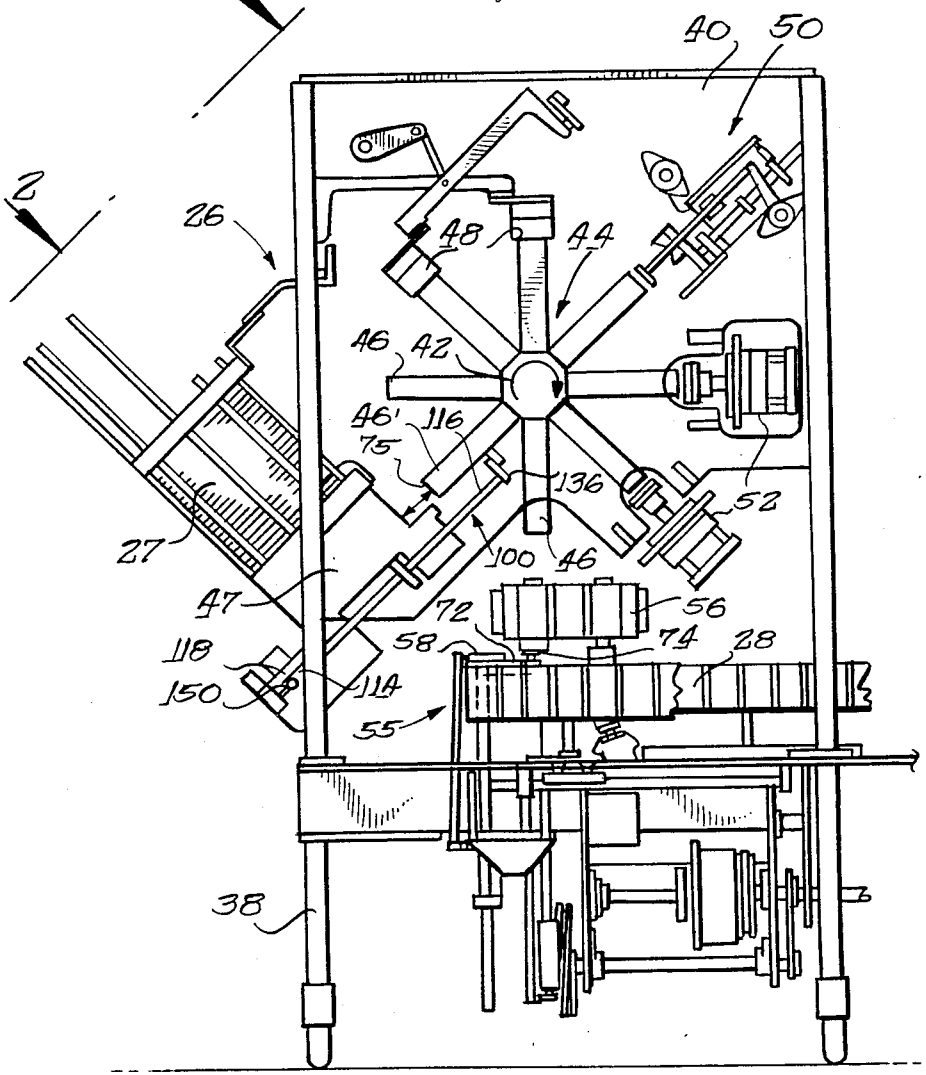
FIG. 1 is a side elevational view of machinery for performing operations on cartons, incorporating one preferred embodiment of the stop assembly of the present invention.

Referring now to FIG. 1, the carton stop assembly of the present invention will be described with respect to a station 26 for forming the bottom portions of well-known gable-top cartons. The construction and operation of station 26 is fully described in U.S. Pat. No. 4,588,391, issued May 13, 1986 to James W. Evans, John P. Scheid and Daniel R. Eichinger, assigned to the assignee of the present invention, which is herein incorporated by reference. Machinery at the forming station 26 includes a magazine for holding a stack of carton blanks 27 as well as machinery which forms the carton blanks into four-sided tubes and encloses and seals their bottoms. The machinery also includes a main conveyor 28 which receives the formed cartons and which is indexed by a drive system (not shown) to advance the cartons to downstream filling and closing stations, also not shown. An example of such stations, and of an overall arrangement including the carton forming station, is more fully discussed in the incorporated-by-reference U.S. Pat. No. 4,588,391.

The carton blanks 27 are formed into the well-known four-sided tube with a gable roof which can be opened to form a pouring spout. These blanks are themselves formed from a paperboard blank having overlapping ends adhered together to define a tube. The carton blanks 27 are held in the magazine in a flattened form.

The machinery at the carton-forming station 26 includes a main frame 38 for supporting components of the drive system main conveyor, and could be used as well to support any downstream filling, closing, or the like stations. Attached to the frame is a vertical support wall 40 which rotatably carries the hub 42 of a turret 44 having eight regularly-spaced radial mandrels 46. The turret 44, which is disposed in vertically overlapping relationship with a carton-receiving end of main conveyor 28, is driven by a well-known controller drive which indexes the turret through a number of carton-forming substations disposed about mandrels 46. More specifically, in analogizing the substation positions to a clock face, at 7:00 o'clock a first mandrel 46' receives a carton blank from the magazine, which includes an infeed mechanism 47 for opening the leading carton blank into the tube and pushing a tube onto mandrel 46'. The prime designation denotes a mandrel 46 which is aligned in registry with a warp plate or infeed mechanism 47. Mandrel 46' is otherwise identical to any of the other mandrels 46. One example of an infeed mechanism which telescopingly inserts open tubular blanks onto a registering mandrel is shown in U.S. Pat. No. 3,486,423, the teachings of which are herein incorporated by reference.

Ovens 48 are provided at 10 o'clock and 12 o'clock positions for heating a thermoplastic coating carried by the lower portions of the carton blank. When the reference mandrel 46' is indexed to a 1 o'clock position, a bottom former 50 breaks the lower panel portions along their score lines and folds them to form a flat bottom, as is known in the art. Bottom sealers 52 are disposed at 3 o'clock and 4 o'clock positions, and they function to fully form the bottom of the carton after the ovens have heated the closure parts to a temperature sufficient to activate the adhesive characteristic of the thermoplastic coating. Each sealer includes a pressure pad which advances toward the flat distal surface of the aligned mandrel to compress the carton bottom components therebetween. Finally, when the reference mandrel is indexed to the 6 o'clock position, it is properly aligned for a stripper mechanism 58 to remove the formed carton from the mandrel.

Referring again to FIG. 1, a transfer system 55 includes the turret 44, and an intermediate or transfer conveyor 56 which is supported between the turret and the main conveyor 28. The transfer conveyor transfers cartons two at a time, to the main conveyor 28. Transfer system 55 also includes the stripper mechanism 58 for moving formed cartons, one at a time, from a mandrel in the 6 o'clock position to the transfer conveyor 56. The stripper 58 includes a horizontally disposed plate 72 carrying a suction cup 74 which is mounted for reciprocation in a vertical direction. The suction cup is elevated to engage a bottom of a formed carton, and is thereafter lowered to transfer the carton to transfer conveyor 56. Further details of the operation and construction of the transfer system 55 and the assemblies included therein, may be found in the above-mentioned U.S. Pat. No. 4,588,391.

The present invention is directed to that portion of carton-forming station 26 which telescopically inserts an open carton tube onto a mandrel 46' which is located at the 7 o'clock radial position. In particular, the arrangement of the present invention limits the amount of insertion of the carton tube onto the mandrel, and provides a remotely-actuated, conveniently adjustable stop associated with the mandrel which can accommodate a number of cartons having different volume-carrying capacities, that is, cartons having the same cross-sectional dimensions but having different lengths.

Frequently, the same production line is used to package the same product in a variety of different-sized containers having the same cross section but different lengths. As pointed out above, the carton-forming station 26 used to illustrate the preferred embodiment, is a bottom-forming station, where the bottom flaps of carton tube are brought into engagement with the free end 75 of a mandrel 46. Different length tubes must therefore be inserted different amounts on mandrel 46' if the bottom end portions are to be similarly aligned with the mandrel free end. As will be appreciated, it is not practical to limit tube insertion by engaging the free ends of the mandrels with the insertion mechanism, since the tube is not completely inserted on the mandrel. Rather, a defined amount of "overhang" is necessary so that overlapping flap portions of the tube can be folded over one another to engage the mandrel-free end.

Figure 2:
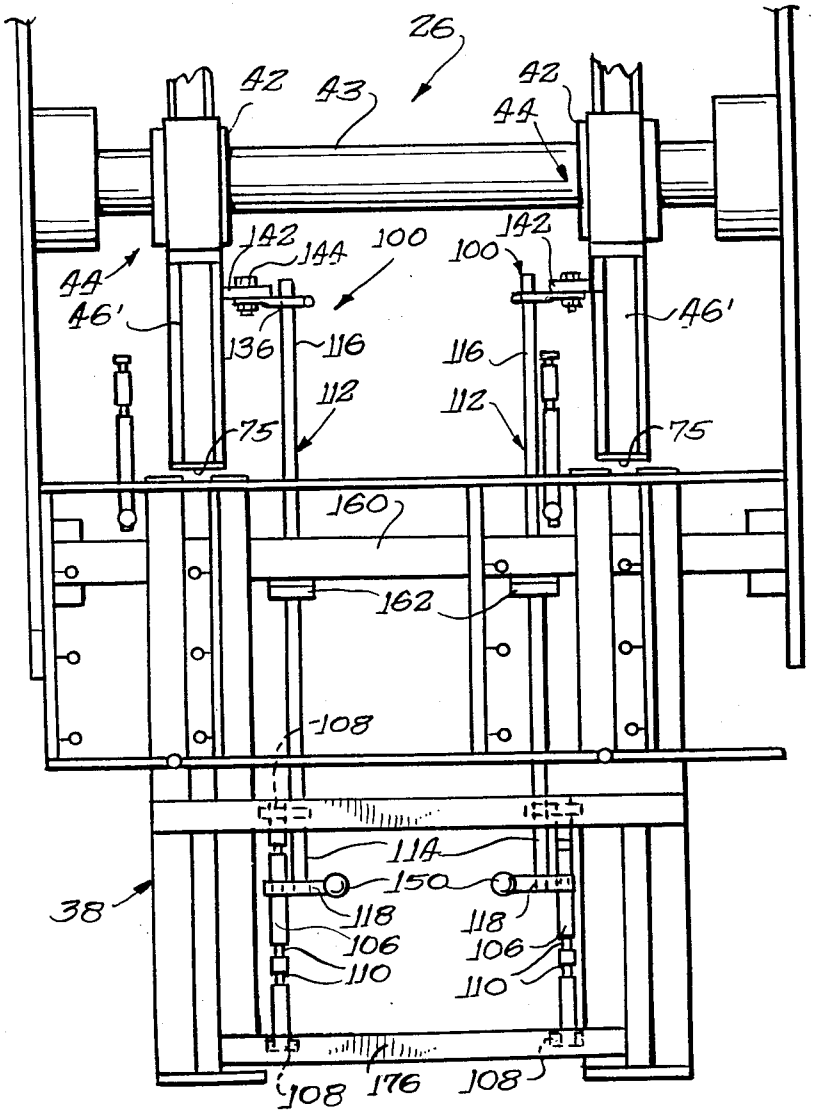
FIG. 2 is top view taken generally along line 2—2 of FIG. 1 illustrating multiple carton-forming stations.

In the past, stops have been slidably mounted directly on the tube-carrying mandrels. However, adjustment of the stops requires an operator to reach into the machinery. According to the present invention, remote actuation of a carton-engaging stop means is provided, whereby an operator can change position of the carton stop without reaching into the carton-forming mechanism. Referring now to FIGS. 1 and 2, a carton stop assembly of the present invention, generally indicated at 100, is provided for each turret 44 and is operatively associated with each mandrel of the turret.

FIG. 1 shows a mandrel 46' at a first radial position, where it is aligned in registry with infeed mechanism 47, ready to receive a carton tube. The stop assembly 100 is shown in greater detail in the remaining FIGS. 3–7.

Referring now to FIG. 2, a fixed track 106 is mounted to frame 38 by brackets 108. Track 106 is remote from turret 44, and is parallel to the registering mandrel 46'. A series of annular detents or depressions 110 are located at a series of spaced detent positions along track 106. An axially-reciprocable shaft 112 is arranged parallel to track 106 and to the registering mandrel 46', so that its outer end 114 overlies the track, and its inner end 116 overlies the registering mandrel 46'. A track engagement member 118 is carried by outer end 114 of the shaft 112. The inner end 116 of the shaft 112 is shown in greater detail in FIG. 3, and the outer end 114 is shown in greater detail in FIG. 4, as will be discussed below.

Figure 4:
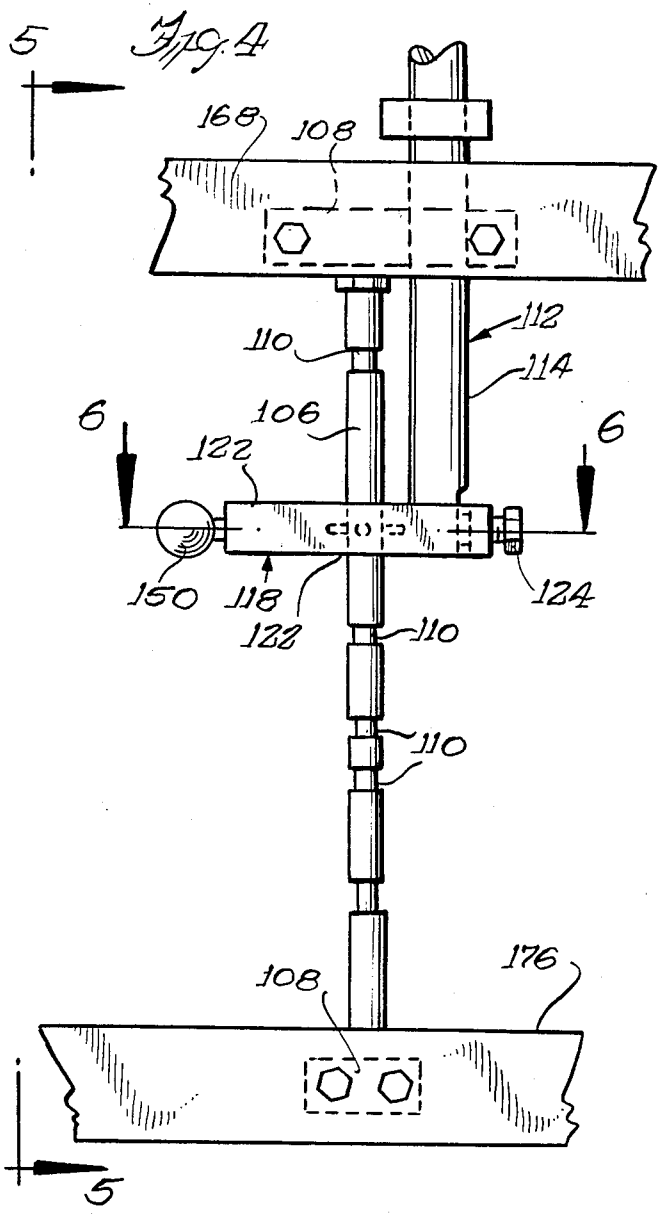
FIG. 4 is an enlarged view of the bottom right-hand portion of FIG. 2 showing the outer end of the stop assembly.
Figure 3:
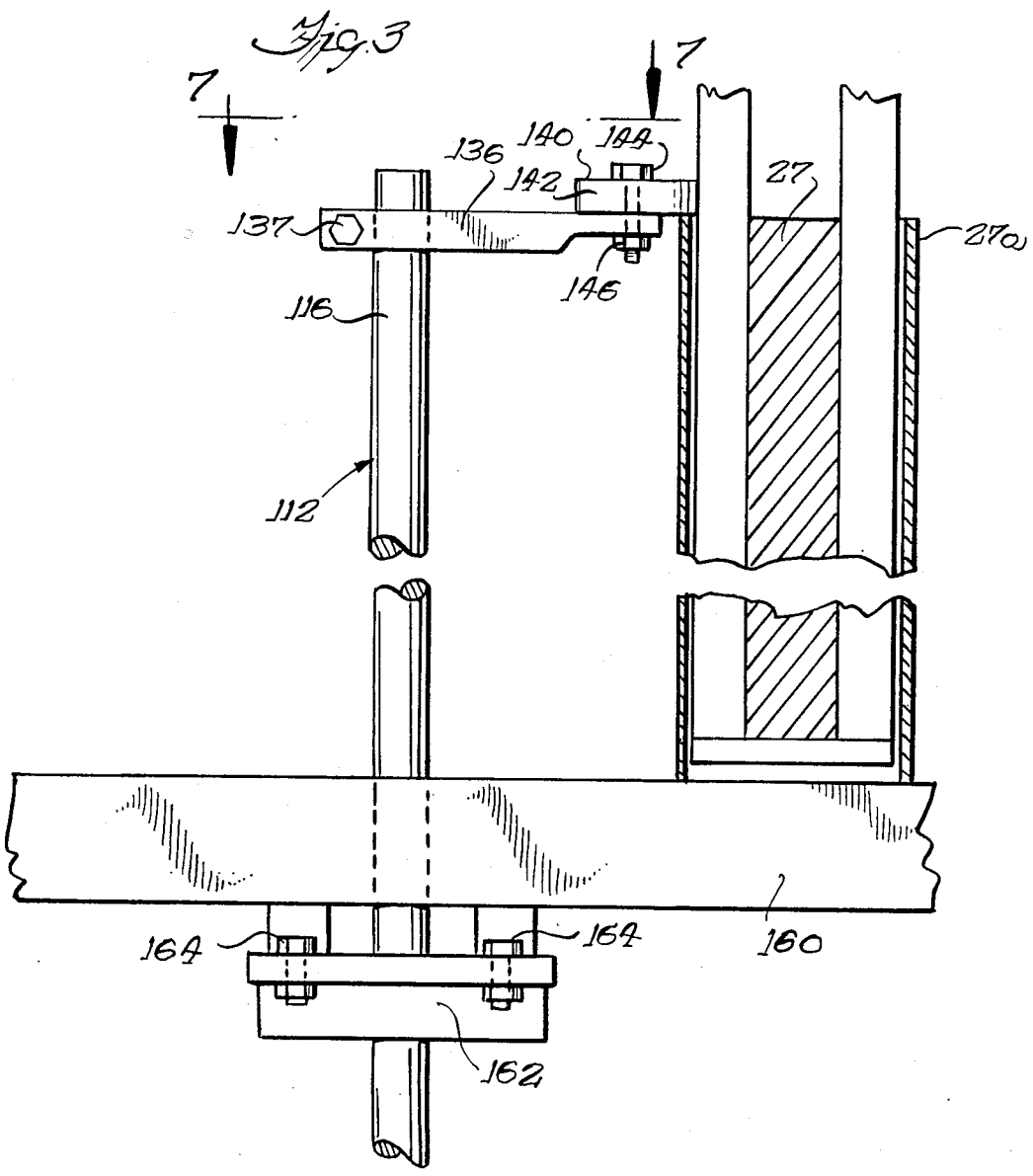
FIG. 3 is an enlarged view of the upper right-hand portion of FIG. 2 showing the inner end of the stop assembly.
Figure 5:
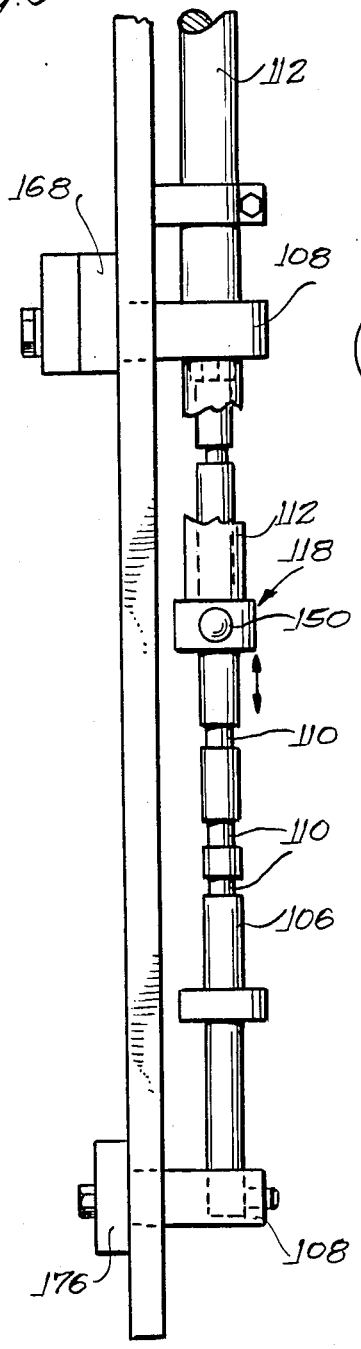
FIG. 5 is a side view taken along the line 5—5 of FIG. 4.
Figure 6:
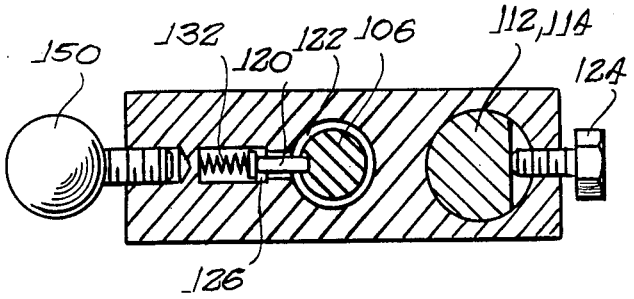
FIG. 6 is a sectional view taken along the line 6—6 of FIG. 4.
Figure 7:
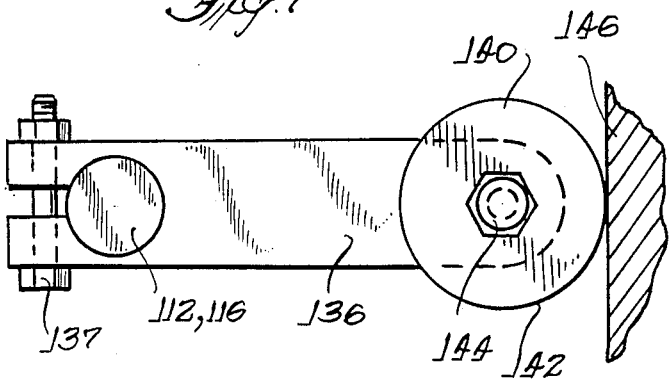
FIG. 7 is a plan view of the inner end of the carton stop means according to one preferred embodiment of the present invention, taken along line 7—7 of FIG. 3.

Referring now to FIGS. 4–6, track engagement member 118 has a body 120 in which an opening 122 is formed to slidingly receive track 106, permitting the track engagement member to be slid along the track as shaft 112 is reciprocated back and forth. A screw 124 fixes body 120 to shaft 112. Referring especially to FIG. 6, a radial cavity 126 is formed in body 120 adjacent opening 122. Cavity 126 houses a spring-loaded plunger 128 which projects into opening 122. Plunger 128 is biased by a spring 132 toward track 106, and in particular toward detents 110. As shaft 112 is reciprocated toward and away from hub 42, track-engaging member 118 travels back and forth along track 106, with plunger 128 moving from detent to detent. Alternatively, plunger 128 could be mounted in a separate body member which is bolted to bracket body 120, adjacent opening 122.

Referring now to FIGS. 1–3 and 7, the inner end 116 of shaft 112 carries a bracket 136 which is fixed to shaft 112 by a screw 137. A disk 140 having an outer peripheral surface 142 is fixed to bracket 136 by a bolt 144 and a nut 146. Bracket 136 is dimensioned to bring disk peripheral surface 142 into slight engagement with mandrel 46' as shown most clearly in FIG. 3.

In a tube insertion operation, the leading end 27*a* of a carton tube 27 abuttingly engages disk 140 to effectively limit tube insertion on mandrel 46'. Typically, a slight engagement or near engagement of disk 140 with mandrel 46' is necessary to prevent slippage of the carton tube therepast during insertion. If the carton stock is thick enough, engagement between disk 140 and mandrel 46' may not be necessary to reliably block further passage of the carton tube.

As shaft 112 is reciprocated toward and away from hub 42, disk 140 is located at a series of positions along mandrel 46' as plunger 128 engages detents 110 at a corresponding series of detent positions. A handle 150 is provided on track engagement member 118 to allow the operator to manipulate shaft 112 from a point remotely located from turret 44 and from other moving components of station 26 (see FIG. 1).

Referring again to FIG. 1, after receiving a carton tube, turret 44 is rotatably indexed by a drive system, not shown, to move mandrel 46' to a next work station to initiate the bottom-forming process, and to bring a second mandrel into registry with infeed mechanism 47. An example of a suitable drive system is disclosed in the incorporated-by reference of U.S. Pat. No. 4,588,391. As turret 44 is indexed, disk 140 comes into contact with each mandrel that is registered with infeed mechanism 47. Thus, only one adjustment is needed for a turret, instead of an adjustment for each mandrel of the turret.

As shown most clearly in FIG. 2, a stop assembly 100 is needed for each turret 44 located at station 26. Usually, the turrets will be mounted on a common drive shaft, such as the drive shaft 43 of FIG. 2, and the mechanisms associated with each turret will be similarly arranged. The operating handles 150 of each stop assembly 100 are easily accessible since those handles will be aligned side-by-side, in registry with each other. Of course, the handles can be linked to a common actuator lever, or to linkage driven by a stepper motor, if desired.

Various mounting fixtures for the stop assembly are shown in the figures. For example, in the preferred embodiment illustrated in FIG. 2, a first structural cross member 160 is utilized to provide support for the inner portion 116 of shaft 112. As shown in greater detail in FIG. 3, cross member 160 supports a journal 162 which is secured thereto by bolted brackets 164. An intermediate cross member 168 supports a bolted bracket 108 as well as an end connection for the inner end of track 106, as shown in FIG. 4. An outer cross member 176 provides fixed support for the outer end of track 106 by bolted brackets 108. Such fixed and journaled support for the track 106 and shaft 112 may take any convenient form, depending upon the particular configuration of the device with which the stop assembly 100 is utilized.

Other variations of the illustrated stop assembly are also contemplated by the present invention. For example, disk 140 is shown concentrically mounted on bracket 136. If desired, mounting for disk 140 could be off-center to provide a further degree of alignment between the outer disk surface 140 and mandrel 46'. Further, the disk member 142 could be replaced by a non-circular plate, such as an ellipse or other non-circular shape, as long as the important feature of maintaining close contact or near-contact with mandrel 46' is provided.

Other variations of the stop assembly 100 might include alternative detent engaging means. For example, the spring-loaded plunger 128 could be replaced by a spring band which is secured at each end to bracket body 120 and which protrudes into opening 122 so as to engage track 106. Other alternative arrangements of detent engaging means will become apparent to those skilled in the art. No matter which alternative is used, the principal feature of the detent engaging means is to provide selective positioning of bracket 118 at various, radially-oriented distances from hub 42 such that the mandrel-engaging disk 140 is moved among various selected positions along the mandrel 46'.

It can now be appreciated that the specific design of the infeed mechanism 47 and of the turret indexing means is not critical to the stop assembly of the present invention. That is, the stop assembly of the present invention provides an interference stop for engagement with a tube-like member telescoped onto a mandrel, with the disk of the stop assembly being arranged to abuttingly engage the leading end of the tube being inserted.

Although the carton stop arrangement of the present invention is described with respect to a carton-forming station, those skilled in the art will readily appreciate that application of the carton stop is not so limited. Further, the present invention is not intended to be limited to cartons which are liquid-filled, it being realized that gable-topped cartons carry a variety of solid products as well. In view of the above, it will be seen that the several objects of the invention are achieved and other advantageous results obtained.

As various changes in addition to those pointed out above, could be made in the above-described constructions without departing from the scope of the invention, it is intended that all matter contained in the above description or shown in the accompanying drawings shall be interpreted as illustrative and not in a limiting sense.

What is claimed is:

1. An adjustable stop in a machine for performing operations on a series of tubular blanks, the machine including a rotatable hub supporting a plurality of spaced outwardly directed mandrels for carrying said tubular blanks, and insertion means for telescopically inserting a tubular blank over one of the mandrels which is at a preselected radial position, said adjustable stop comprising:

a shaft extending generally parallel to said one mandrel having a first end at least partially overlying said one mandrel and a second end remote from said mandrel;

means for mounting said shaft in a generally fixed position as plural mandrels are successively positioned at said preselected radial position;

blank engaging means at a preselected fixed position along said shaft adjacent the first end thereof for engaging tubular blanks inserted over plural mandrels which are at said preselected radial position to limit the extent of insertion thereof, said blank-engaging means remaining at said preselected fixed position while said plural mandrels are successively brought into said preselected radial position to receive respective tubular blanks; and means for axially repositioning and locking said shaft so as to selectively position said blank engaging means at a plurality of preselected positions along a mandrel located at said preselected radial position.

2. The adjustable stop of claim 1 wherein said blank engaging means is rigidly attached to said shaft so as to be adjustably spaced from a mandrel in said preselected radial position.

3. The adjustable stop of claim 1 wherein said blank engaging means includes a disk-like member extending generally perpendicular to said shaft and eccentrically fastened thereto so as to be adjustably spaced from said mandrel.

4. The stop means of claim 1 wherein said axial repositioning means comprises:

a track;

a plurality of detent means defining detent positions spaced along said track; and detent engagement means at said second end of said shaft for engaging said detent means so as to be positionable along said track at said plurality of detent positions, whereby said blank engaging means is positionable along said one mandrel at a corresponding plurality of positions.

5. The stop means of claim 4 wherein said axial repositioning means further comprises a bracket secured to said second end of said shaft, said bracket including a body defining an aperture for receiving said track therethrough, and means for mounting said detent engaging means adjacent said aperture.

6. In a machine for forming cartons of paperboard or the like from blanks, comprising in combination a magazine adapted to hold a supply of said blanks, a rotatable hub carrying a plurality of spaced radial mandrels, means for rotatably driving said hub with a step-by-step indexing motion, means for feeding blanks successively from said magazine to said mandrel assembly so as to telescopically insert a carton blank over one of said mandrels at a preselected radial position and for erecting said blanks into open-ended tubular form as an incident to such feeding, a plurality of stations with which said mandrel assembly is adapted to register for breaking the folds of the bottom closure parts and for closing and sealing said bottom closure parts, and means for stripping said partially-formed carton blanks from said mandrel assembly, an adjustable stop means comprising:

a shaft extending generally parallel to said one mandrel having a first end at least partially overlying said one mandrel and a second end remote from said mandrel;

means for mounting said shaft in a generally fixed position as plural mandrels are successively positioned at said preselected radial position;

blank engaging means at a preselected fixed position along said shaft adjacent the first end thereof for engaging tubular blanks inserted over plural mandrels which are at said preselected radial position to limit the extent of insertion thereof, said blank-engaging means remaining at said preselected fixed position while said plural mandrels are successively brought into said preselected radial position to receive respective tubular blanks; and means for axially repositioning and locking said shaft so as to selectively position said blank engaging means at a plurality of preselected positions along a mandrel located at said preselected radial position.

* * * * *